US006852005B2

(12) United States Patent
Goldau et al.

(10) Patent No.: US 6,852,005 B2
(45) Date of Patent: Feb. 8, 2005

(54) DEVICE FOR PROCESSING THE FINISH OF WORK PIECES

(75) Inventors: Harald Goldau, Wuppertal (DE); Peter Brust, Wuppertal (DE)

(73) Assignee: Ernst Thielenhaus GmbH & Co. KG, Wuppertal (DE)

( * ) Notice: Subject to any disclaimer, the term of this patent is extended or adjusted under 35 U.S.C. 154(b) by 86 days.

(21) Appl. No.: 10/190,786

(22) Filed: Jul. 8, 2002

(65) Prior Publication Data

US 2003/0017793 A1 Jan. 23, 2003

(30) Foreign Application Priority Data

Jul. 19, 2001 (DE) ..... 101 35 139

(51) Int. Cl.[7] ..... B24B 49/00; B24B 51/00
(52) U.S. Cl. ..... 451/10; 451/177
(58) Field of Search ..... 451/5–10, 41, 451/28, 177

(56) References Cited

U.S. PATENT DOCUMENTS

| | | | | | |
|---|---|---|---|---|---|
| 3,675,517 A | * | 7/1972 | Tadayoshi | 82/118 |
| 3,805,661 A | * | 4/1974 | Tuomaala | 83/666 |
| 4,143,572 A | * | 3/1979 | Schonmeier | 83/501 |
| 5,072,550 A | | 12/1991 | Matsumoto | |
| 5,477,845 A | * | 12/1995 | Zuzelo | 125/15 |
| 6,012,372 A | * | 1/2000 | Laster et al. | 83/665 |
| 6,443,818 B1 | * | 9/2002 | Bent | 451/177 |

FOREIGN PATENT DOCUMENTS

| | | |
|---|---|---|
| DE | 571 924 C | 3/1933 |
| DE | 34 30 557 A | 2/1986 |
| DE | 39 30 457 | 3/1991 |
| DE | 197 38 818 | 3/1999 |
| DE | 199 52 805 A | 8/2000 |

* cited by examiner

*Primary Examiner*—Lee D. Wilson
(74) *Attorney, Agent, or Firm*—Collard & Roe, P.C.

(57) ABSTRACT

A device for processing the finish of work pieces. The device has a feed unit with a slide and an NC-controlled drive, a motorized spindle unit with a motor-driven tool spindle, and a force measurement device. The force measurement device is for measuring the contact pressure that is brought to bear upon the tool spindle in the course of processing a work piece. According to the invention, the motorized spindle unit is seated on the slide with resilient elements that accept the weight of the motorized spindle unit and are movable only in the direction of processing. The slide is supported on leaf springs, which are oriented perpendicular to the direction of advance of the slide. The force measurement device is arranged on the motorized spindle unit and on the slide between the connective elements.

9 Claims, 2 Drawing Sheets

DEVICE FOR PROCESSING THE FINISH OF WORK PIECES

CROSS REFERENCE TO RELATED APPLICATIONS

Applicant claims priority under 35 U.S.C. §119 of German Application No. 101 35 139.9 filed Jul. 19, 2001.

BACKGROUND OF THE INVENTION

1. Field of the Invention

The invention relates to a device for processing a finish on the surface of work pieces. The device has a feed unit with a slide and a drive that is Numerically Controlled (NC)-controlled, a motorized spindle unit with a motor-driven tool spindle. There is also a device for measuring the force of contact pressure that is brought to bear upon the tool spindle in conjunction with a processing of a work piece.

2. The Prior Art

The prior art in German Patent No. DE 39 30 457 A1 shows a process of measuring the force of the contact pressure that is brought to bear upon the tool spindle continually in the course of processing a work piece. The process subsequently regulates, by degrees, the contact pressure of the processing tool on the surface of the work piece, to a pre-determined limit at which there is an optimal removal of material. Furthermore, German Patent No. 197 38 818 A1 describes a process wherein, depending upon deviations in the measurements, and the form of the geometry of the work piece, the device controls the contact pressure or rather, the feed, of the work piece to be processed. The tool support is equipped with a measuring device that has a precision indicator and supporting elements.

In processing the finish of work pieces that have small parts, such as seating surfaces of fuel injector valves, or flat surfaces of miniature pressure sensors, etc., precision-guided feeding motions of the rotating grinding tool are necessary to meet the high standards for retaining the dimensions and the surface quality of the processed work piece. The feed must be set so that the processing tool lies against the surface of the prospectively processed work piece with a defined force that can be adjusted in a very sensitive manner. As a rule, contact forces of less than 100 N must be set and, in the case of very small work pieces, contact forces on an order of magnitude of 1 to 25 N must be set.

SUMMARY OF THE INVENTION

One object of the invention is to create a device for processing the finish of work pieces that has power-controlled feeding motions. This device has a contact pressure that can be adjusted with sensitivity and maintained with precision.

The task is performed by using a device having a motorized spindle unit, having resilient elements that accept the weight of the motorized spindle unit and can be moved only in the direction of processing. This device is seated on a slide, wherein the device that measures the force is arranged between connective elements on the motorized spindle unit and on the slide.

The motorized spindle unit is preferably supported on leaf springs, which are oriented perpendicular to the direction of the slide's advance. The leaf springs, which are oriented vertically, and mounted with a short exposed length, are very flexible and yield in the direction of the spindle's advance.

Thus, the contact forces at the tool spindle are transferred to the device that measures the force in a manner that is sensitive and involves little loss. When mounted with a short exposed length, the leaf springs can accept great vertical forces as well as great transverse forces. Therefore, they lend themselves to supporting the motorized spindle unit on the slide, wherein additional guides, which are subject to friction, are not necessary.

The device for measuring the force is arranged between the resilient elements, for example, on the underside of the motorized spindle unit between the leaf springs or, in the direction of the work, it can be connected to the end of the motorized spindle unit that faces the rear. According to a preferred embodiment, the unit that measures the force has a piezo element as a force sensor. The piezo element provides very precise measurements of force, with extremely low degrees of deformation. However, the use of other force sensors should not be precluded. For example, this device can also include expansion measurement strips or magneto restrictive sensors.

The force sensor, such as a piezo element, is arranged between two contact elements that have spherical contact surfaces. The spherical contact surfaces are supported on annular or dish-shaped bearing surfaces of the connective elements, which are disposed on the motorized spindle unit and on the slide. In the present embodiment, the force sensor is mounted having no transverse forces, and the contact forces that are brought to bear upon the tool spindle are transferred to the force sensor in a manner that exhibits little loss. In the process, pre-stressing the force sensor creates a beneficial effect. In an advantageous embodiment, the contact elements are in the form of bolts, such that one bolt exhibits a threaded borehole and the other bolt exhibits a longitudinal borehole. In this case, the bolts are braced against the force sensor with a defined force of pre-tension by means of an expansion screw. Furthermore, the connective element for the force measurement device, which is arranged on the slide is, preferably arranged on a carrier, which is attached in guidance grooves of the slide so that it can be moved for adjustments.

This device allows a very precise and sensitive detection of those contact forces that are used on the working spindle in processing the finish of work pieces. The measurement values of the force are led to the NC control of the feed drive. With a high-resolution NC feeding of the slide, minimal forces, such as forces defined within the range between 0.1 N and 10 N, can be used on the work piece. The result is a high quality surface when processing the finish of serially produced parts having small pieces. With a pathway measurement system that can be integrated into the device, it is possible to detect progress along the feed pathway over time, via measurement technology. From the measurement values of the force measurement device and/or the pathway measurement system, it is possible to derive control commands for guiding the process in conjunction with the processing of the work piece.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
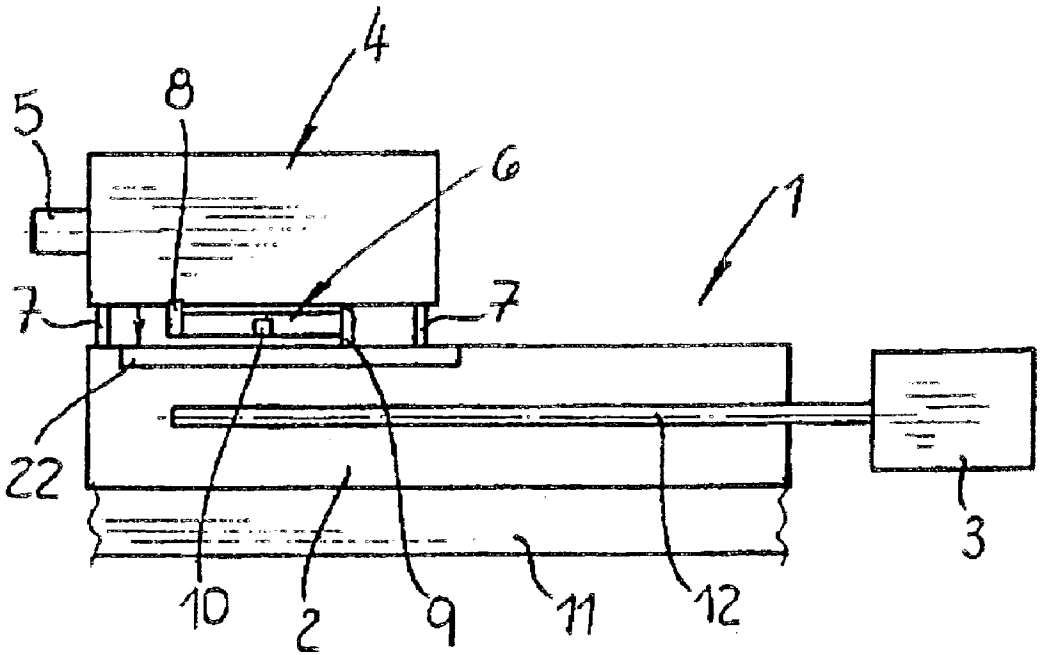
FIG. 1 shows a schematic view of a device for processing the finish of work pieces.

Referring to the drawings, there is shown, a feed unit 1, having a slide 2 and an NC-controlled drive 3. There is also a motorized spindle unit 4 with a motor-driven tool spindle 5, and a device that measures force 6, for measuring the contact pressure that is brought upon tool spindle 5 in conjunction with processing a work piece. Motorized spindle unit 4 is seated on slide 2 via a plurality of leaf springs 7, wherein leaf springs 7 are oriented perpendicular to the direction of advance of slide 2 and accept the weight of motorized spindle unit 4. Force-measuring device 6 is arranged between connective elements 8, 9, on motorized spindle unit 4 and on slide 2. Force measuring device 6, is equipped with a piezo element as a force sensor 10. Slide 2 is a precision slide guide 11 that is embodied in accordance with the state of the art, as well as a roller spindle 12 as the propulsion aggregate. Other embodiments of feed unit 1, such as a linear drive, are not precluded.

Figure 2:
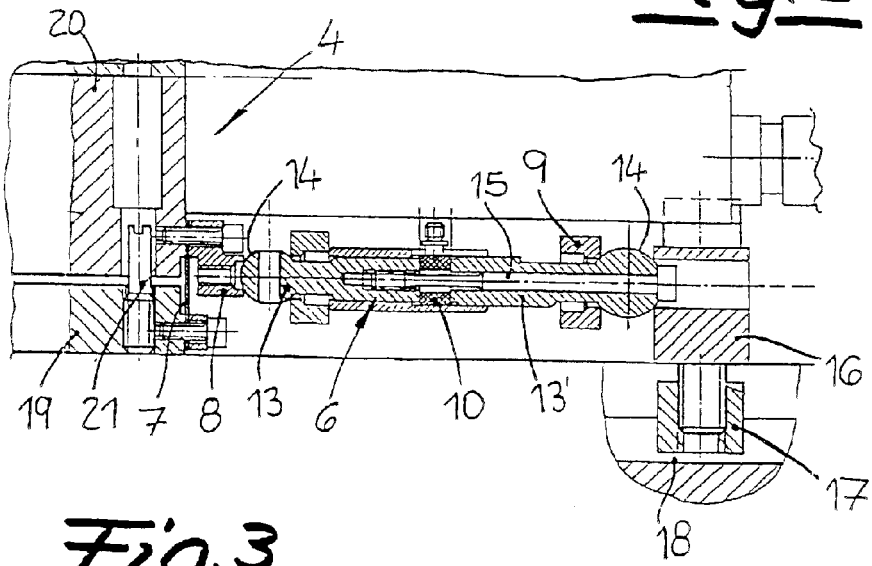
FIG. 2 shows a schematic view of an additional embodiment of the invention.
Figure 3:
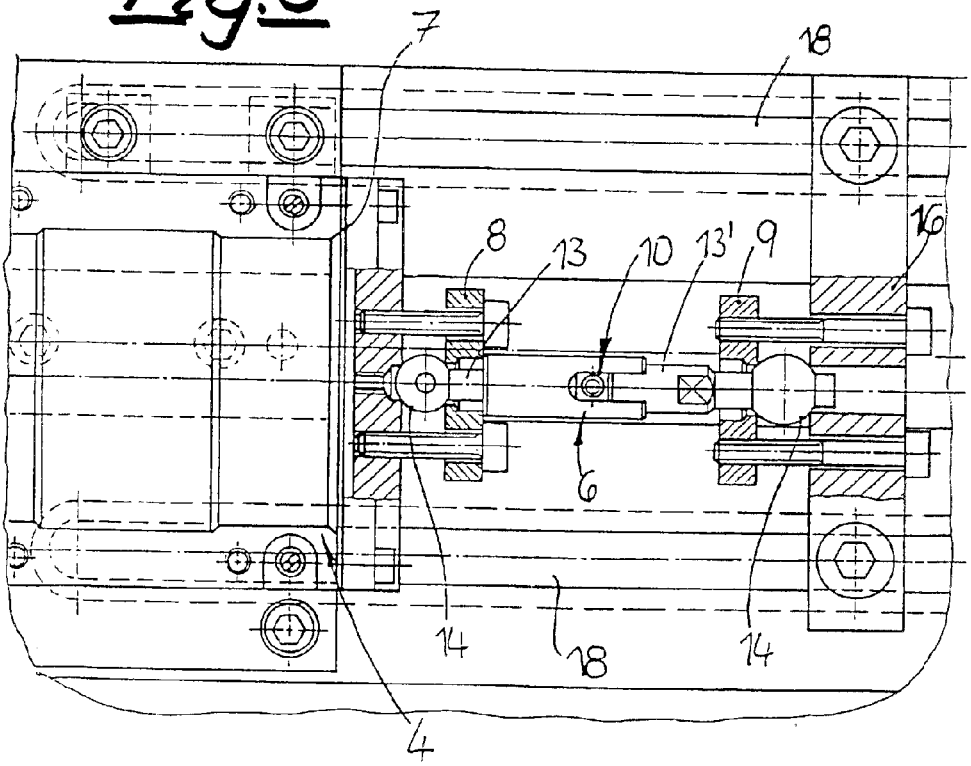
FIG. 3 shows a top schematic view onto the object represented in FIG. 2.

FIGS. 2 and 3 show the mounting of leaf springs 7, as well as the embodiment of force measurement device 6. Force sensor 10 is arranged between two contact elements, which are embodied as bolts 13, and 13' in the embodiment example, and have contact surfaces 14. Contact surfaces 14 are supported at annular or dish-shaped bearing surfaces of the of connective elements 8, 9. One of bolts 13, has a threaded borehole, the other bolt 13', a longitudinal borehole. Bolts, 13, 13', are pre-stressed, with a defined force of pre-tension, against force sensor 10, which is arranged between bolts 13, 13', via an expansion screw, 15. A pre-tension force between 100 and 200 N is beneficial. FIGS. 2 and 3 show that connective element 9 on the same side as slide 2 is arranged on a carrier 16 for force-measuring device 6. Force measuring device 6 is attached via tenon blocks 17 in guide grooves 18 of slide 2 to allow for adjustments.

FIGS. 2 and 3 show that force measurement device 6 is connected to the rear end of motorized spindle 4, in the direction of the work. Two leaf springs 7, of which only the rearward leaf spring is depicted in FIGS. 2 and 3, are attached with a short mounting length to carrier plates 19 and 20, which are attached to slide 2, or to the underside of motorized spindle unit 4. Securing pins 21 prevent large movements of motorized spindle unit 4 when tool changes, or other mounting work is performed.

Force measurement device 6, shown in FIGS. 2 and 3, can also be arranged on the underside of motorized spindle unit 4, between leaf springs 7, as shown in FIG. 1.

The device according to the invention can, in addition, be equipped with a device for measuring the length of pathway 22, wherein the course of the feed pathway over time can be determined via measurement technology. Control commands to direct the process in the processing of work pieces can be derived from the force measurement values and from the measurement values of the pathway measurement system. When the work piece is cut, wherein, when the tool (not shown) makes contact with the work piece, the force-controlled feed rate of advance declines rapidly, wherein the course of the curve, over time, flattens as the removal of material from the surface of the work piece increases.

It is possible to derive criteria for the optimal management of a finish-processing process from the course of the feed pathway over time. Thus, the profile of the feed pathway over time can be used as a measure of the quality of the surface of the work piece. With a prescribed contact pressure between the work piece and the processing tool (not shown), the force-controlled rate of feed reaches a rate that is approximately constant with increasing surface quality.

By setting a value of ideal force within the described range of settings, between 0.1 and 100 N, it is possible to change the amount of material removed and the resultant rate of feed. With an optimal force relative to the process, a higher surface quality is generally reached very constantly. The parameter adjustments can be optimized so that the desired surface quality is achieved with minimal processing time.

From the course of the feed pathway over time, it is possible to derive a signal value that characterizes the cutting behavior to add to a tool, to identify any breakage of a tool that might occur, or to identify tool wear. Furthermore, from the course of the feed pathway over time, it is possible to ascertain instabilities in the process.

Accordingly, while only a few embodiments of the present invention have been shown and described, it is obvious that many changes and modifications may be made thereunto without departing from the spirit and scope of the invention.

What is claimed is:

1. A device for processing a finish on a worked piece comprising:

a) a feed unit;

b) a slide coupled to said feed unit;

c) a NC controlled drive coupled to said slide;

d) a motorized spindle unit disposed on said slide and having a plurality of resilient elements that are movable in a direction of processing;

e) a motor driven tool spindle coupled to said motorized spindle unit;

f) a plurality of connecting elements connecting said motorized spindle unit and said slide together; and g) means for measuring forces which is arranged on said motorized spindle unit and on said slide between said plurality of connecting elements.

2. A device as in claim 1, further comprising a plurality of leaf springs wherein said motorized spindle unit is supported on said plurality of leaf springs and said plurality of leaf springs are arranged in a direction that is perpendicular to a direction of an advance of said slide.

3. A device as in claim 1, wherein said means for measuring forces, is arranged between said plurality of resilient elements on said motorized spindle unit.

4. The device as in claim 1, wherein said means for measuring forces is coupled to said motorized spindle unit toward a back end of a direction of the axis.

5. The device as in claim 1, further comprising a piezo electric element coupled to said force measurement device wherein said piezo electric element acts as a force sensor.

6. A device as in claim 1, further comprising a force sensor, integrated with said means for measuring forces wherein said force sensor is arranged between two contact elements and wherein said contact elements have spherical contact surfaces that are supported on annular or dish shaped surfaces of said plurality of connecting elements which are disposed on said motorized spindle element and said slide.

7. The device as in claim 6, wherein said contact elements are in the form of bolts wherein at least a first bolt has a threaded bore hole and at least a second bolt has a longitudinal bore hole and wherein the device further comprises an expansion screw for bracing said bolts at a defined pretension against said force sensor, which is arranged between said bolts.

8. A device as in claim 1, wherein one of said plurality of connecting elements, which is used to couple said slide to said carrier, is attached to a plurality of guide grooves of said slide, wherein said connective element is movably attached to allow for adjustments.

9. A device for processing a finish on a worked piece comprising:

a) a feed unit;

b) a slide coupled to said feed unit;

c) a NC controlled drive;

d) a plurality of leaf springs;

e) a motorized spindle unit having resilient elements that are movable in a direction of processing wherein said motorized spindle unit is seated on said plurality of leaf springs which are coupled to said slide;

f) a motor driven tool spindle coupled to said motorized spindle unit;

g) a plurality of connecting elements coupling said motorized spindle unit to said force measuring device; and h) a force measuring device, having a force sensor, wherein said force measuring device is arranged on said motorized spindle unit and on said slide between said plurality of connecting elements.

* * * * *